US006141026A

United States Patent [19]

Domoto et al.

[11] Patent Number: 6,141,026

[45] Date of Patent: Oct. 31, 2000

[54] LIQUID INK DEVELOPMENT CONTROL

[75] Inventors: Gerald A. Domoto, Briarcliff Manor; Oscar G. Hauser, Rochester; Fong-Jen J. Wang, Pittsford, all of N.Y.

[73] Assignee: Xerox Corporation, Stamford, Conn.

[21] Appl. No.: 09/141,378

[22] Filed: Aug. 27, 1998

Related U.S. Application Data

[60] Provisional application No. 60/063,866, Oct. 31, 1997.

[51] Int. Cl.[7] ..... G03G 13/04; B41J 2/385

[52] U.S. Cl. ..... 347/140; 399/251

[58] Field of Search ..... 347/112, 115, 347/140; 399/249, 251

[56] References Cited

U.S. PATENT DOCUMENTS

| | | | |
|---|---|---|---|
| 4,782,347 | 11/1988 | Kurematsu et al. . | |
| 5,247,334 | 9/1993 | Miyakawa et al. | 399/251 X |
| 5,552,869 | 9/1996 | Schilli et al. | 399/251 |
| 5,557,377 | 9/1996 | Loewen et al. | 399/249 X |
| 5,574,547 | 11/1996 | Denton et al. | 399/251 |
| 5,640,655 | 6/1997 | Shoji | 399/249 |
| 5,805,963 | 9/1998 | Teschendorf et al. | 399/249 |
| 5,815,779 | 9/1998 | Abramsohn | 399/249 |
| 5,987,284 | 11/1999 | Lewis | 399/249 |

*Primary Examiner*—Sandra Brase

[57] ABSTRACT

An enhanced image conditioning process for liquid ink development assists in achieving better developability and metering capability, especially for the cases where highly viscous developer fluids are used. By selectively heating the developer fluid in the vicinity of the development zone and/or the metering zone, the viscosity of the liquid is reduced, and hence better developability and a thinner film with higher solid content for the developed image can be obtained. Another benefit of lowering the viscosity of the developer fluid is that the developer fluid can be applied and metered at a faster rate than higher viscosity fluids. Liquid ink developability control by controlling ink temperature is advantageous over conventional methods of xerography.

20 Claims, 5 Drawing Sheets

LIQUID INK DEVELOPMENT CONTROL

This appln claims the benefit of U.S. Provisional No. 60/063,866 filed Oct. 31, 1997.

This invention relates generally to a method and apparatus for liquid ink development and more particularly concerns using enhanced metering and developability processes for liquid ink development systems.

Similar to dry powder electrophotography, image stability of a toned liquid ink image is crucial for color printing. To achieve better image stability, reduction of liquid content of a toned image by hydrodynamic metering has been identified as a very effective means of image conditioning. Hydrodynamic metering, accomplished by applying high shear stress, often takes place together with electrophoretic development. The liquid ink is first applied to an image bearing roller or belt at a location upstream of the metering nip. A liquid layer of ink is therefore formed between the image bearing roller and metering roller with a front meniscus where fresh ink enters the development nip on the image roller. A good portion of the incoming ink is also driven away by the metering roller. The incoming ink leaves the development zone from the front end in both the with and against directions of the metering roller. Image-wise electrophoretic development takes place between the two rollers while the electrically conductive metering roller is biased to remove toner from background areas. The film thickness, or liquid content, of a toned image leaving the development zone is determined by the motion of the two rollers, among other things. When metering is performed effectively, the film thickness becomes significantly less than the minimum gap in the development nip. Thin metered films also help in achieving toner-free background development because the amount of toner in the thinner background layers is substantially less than for thicker layers. There are, however, concerns of metering causing image defects when the shear stress exceeds the yield stress that a toned image can withstand and still be held intact by electrostatic, adhesive or cohesive forces.

Another aspect of liquid ink development which needs to be addressed and better controlled is image developability. In conventional automatic development control in dry xerography an infra-red detector (IRD) sensor senses the developed output density on a patch of photoreceptor subsequently feeding back the signal to power supplies. Examples of such conventional development control are taught in U.S. Pat. Nos. 4,318,610, 4,377,338 and 5,210,572. Assuming charged area development, the control variables may include dark image potential (Vddp), developer bias (Vbias), toner concentration and exposure. Some or all of these variables are used in various dry powder machine architectures depending on their particular output density requirements. Problems that have been solved by the use of these devices are machine "morning sickness", long term density stability with photoreceptor photo induced discharge characteristic cyclic variabilities, density stability with developer aging and compensations for environmental changes (temperature and humidity). In a very high quality pictorial output machine, the relationships between dark image potential, developer bias and exposure have to be taken into account to maintain stability in tone reproduction. Thus machine latitudes for copy quality are generally dependent on the sophistication of the control strategy. Conventional control strategies could be used with liquid ink machines with varying degrees of difficulty, however, while developability does depend on the toner concentration of replenishing inks using toner concentration as a control variable may be rather cumbersome.

However, with liquid ink development systems developability depends to a high degree on the ink viscosity which can be precisely controlled by the ink temperature. Therefore, rather than using toner concentration as the control variable (as in dry powder machines) the present invention teaches that ink viscosity be used as the control variable.

U.S. Pat. No. 4,782,347 discloses a recording head with a housing for storing ink, the housing having a plurality of ink passages for allowing the ink to pass from the housing. A plurality of heating elements is selectively heated to allow for the selective passage of ink through the ink passages to a recording medium to record an image. The reduced viscosity of the heated inks is the mechanism by which the ink passes through the ink passages.

U.S. Pat. No. 5,574,547 teaches a liquid electrophotographic reproduction machine with liquid developer holding chambers. The liquid in the developer holding chambers include heating elements for heating the liquid developer within the chambers. The developer fluid is heated to a temperature within a range of 50 to 60 degrees Centigrade for improved developability without causing toner agglomeration.

The above references are hereby incorporated by reference.

While the above references teach that highly viscous inks can be utilized in LID by enabling the ink to flow from storage zones to the ink applicator, the present invention teaches that the highly viscous inks can be used to precisely develop images at high speeds by controlling ink viscosities by means of heating elements in the development zone.

SUMMARY

A liquid ink development system has an ink application member which applies liquid ink to the image formation member to form a developed image area. An image enhancement member removes excess liquid ink from the developed image area and at least one heating member which controls the temperature of the developed image area, the at least one heating member heats the liquid ink after the liquid ink has been applied to the image formation member.

A method for enhancing liquid ink development which includes applying liquid ink to an image formation member having a latent image formed thereon at an ink application station to form a developed image area on the image formation member and removing excess liquid ink from the developed image area with an image enhancement member. The method further includes controlling the temperature of the liquid ink on the developed image area with at least one heating member after the liquid ink has been applied to the image formation member while removing the excess liquid ink with the image enhancement member.

A method for liquid ink development which includes moving an image formation member in a process direction, applying liquid ink to an image formation member having a latent image formed thereon to form a developed image area on the image formation member, removing excess liquid ink from the developed image area with a development member, and removing excess liquid ink from the developed image area with a metering member after the development member as the image formation member moves in the process direction. The liquid ink development is further enhanced by controlling the temperature of the liquid ink on the developed image area with at least one heating member after the liquid ink has been applied to the image formation member.

The enhanced image conditioning process of the present invention assists in achieving better developability and metering capability at high speeds, especially for the cases where highly viscous carrier fluids are used. By selectively heating the ink fluid in the vicinity of the development zone and/or metering zone, the viscosity of the liquid is reduced, and hence better developability and a thinner film with higher solid content for the developed image can be obtained. Another benefit of heating the ink is that the use of higher viscosity inks is enabled. Also, since developability depends uniquely on viscosity (other ink properties held constant the developed image density can be precisely controlled by the temperature of the heating elements in the development zone. This in turn can be conveniently controlled by feedback from patch generation to power supply control settings.

DETAILED DESCRIPTION OF THE INVENTION

Figure 1:
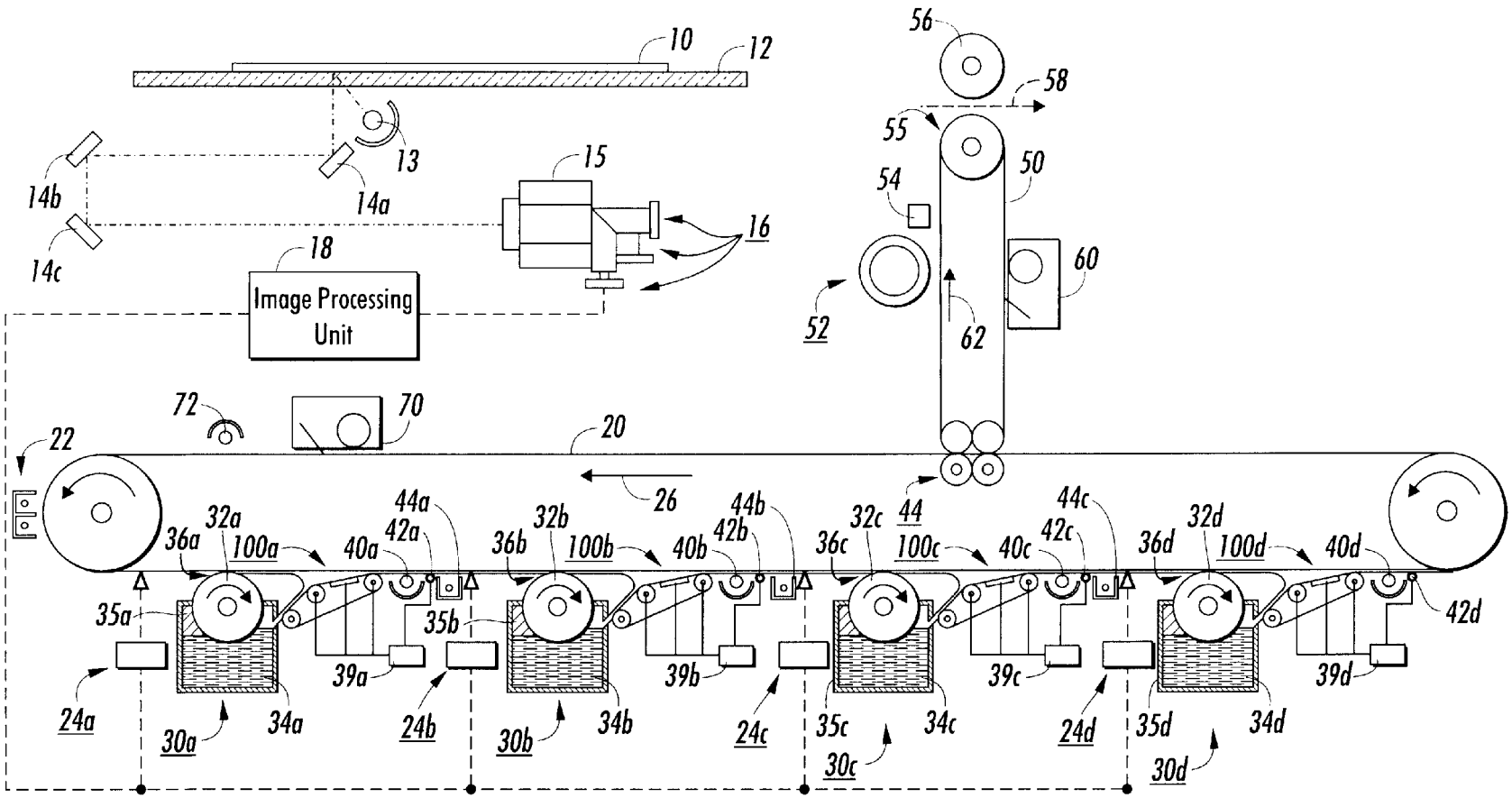
FIG. 1 is a schematic illustration of one form of liquid ink development system utilizing the image enhancement mechanism of the present invention.

For a general understanding of the features of the present invention, reference numerals have been used throughout to designate identical elements. FIG. 1 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, there is shown a color document imaging system incorporating the present invention. The color copy process can begin by either inputting a computer generated color image into the image processing unit 18 or by way of example, placing a color document 10 to be copied on the surface of a transparent platen 12. A scanning assembly consisting of a halogen or tungsten lamp 13 which is used as a light source, and the light from it is exposed onto the color document 10; the light reflected from the color document 10 is reflected by the 1st, 2nd, and 3rd mirrors 14*a,* 14*b* and 14*c,* respectively, then the light passes through lenses (not shown) and a dichroic prism 15 to three charged-coupled devices (CCDs) 16 where the information is read. The reflected light is separated into the three primary colors by the dichroic prism 15 and the CCDs 16. Each CCD 16 outputs an analog voltage which is proportional to the intensity of the incident light. The analog signal from each CCD 16 is converted into an 8-bit digital signal for each pixel (picture element) by an analog/digital converter. The digital signal enters an image processing unit 18. The digital signals which represent the blue, green, and red density signals are converted in the image processing unit into four bitmaps: yellow (Y), cyan (C), magenta (M), and black (B). The bitmap represents the value of exposure for each pixel, the color components as well as the color separation. Image processing unit 18 may contain a shading correction unit, an undercolor removal unit (UCR), a masking unit, a dithering unit, a gray level processing unit, and other imaging processing sub-systems known in the art. The image processing unit 18 can store bitmap information for subsequent images or can operate in a real time mode.

The image member 20, preferably a belt of the type which is typically multi-layered and has a substrate, a conductive layer, an optional adhesive layer, an optional hole blocking layer, a charge generating layer, a charge transport layer, and, in some embodiments, an anti-curl backing layer. It is preferred that the imaging member employed in the present invention be infrared sensitive this allows improved transmittance through a previously developed cyan image. Image belt 20 is charged by charging unit 22. Raster output scanner (ROS) 24*a,* controlled by image processing unit 18, writes a first complementary color image bitmap information by selectively erasing charges on the image belt 20. The ROS 24*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded, image belt 20 advances the electrostatic latent image to development and conditioning station 30*a.* Like subsequent multiple zone image development and conditioning stations apparatus 30*b,* 30*c* and 30*d,* the multiple zone image development and conditioning stations 30*a* includes a housing 35*a,* containing liquid developer material 34*a,* a rotatable ink applicator 32*a,* and a multiple zone image conditioning assembly 100*a* of the present invention. Rotatable applicator 32*a* rotates in the direction of the arrow shown, advancing liquid developer material 34*a* from the chamber of housing 35*a* to image coating nip 36*a.* The toner particles, disseminated through the liquid carrier, pass by electrophoresis to the electrostatic latent image, thus beginning the development process. Then the coated image passes to conditioning assembly 100*a* which is where the development and conditioning processes are completed.

The liquid developers suitable for the present invention generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium, such as those contained in the developers disclosed, for example, in U.S. Pat. Nos. 3,729,419; 3,841,893; 3,968,044; 4,476,210; 4,707,429; 4,762,764; and 4,794,651; and U.S. patent application Ser. No. 08/268,608 the disclosures of each of which are totally incorporated herein by reference. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

After the electrostatic image is coated, it passes to multiple zone image conditioning assembly 100*a,* which completes development and conditions the image by reducing fluid content while inhibiting the departure of toner particles from the image. Thus, an increase in percent solids is provided to the developed image, thereby improving the quality of the developed image. The operation of conditioning station 100*a* will be described in more detail with reference to FIG. 3.

After conditioning assembly 100*a,* the image on image belt 20 advances to lamp 40*a* where any residual charge left on the photoconductive surface is extinguished by flooding the photoconductive surface with light from lamp 40*a*. Sensor 42*a* senses the developability of a development patch which has been developed and metered by development/metering station 100*a*. Based on the developed image information from sensor 42*a,* the temperature of the heating elements of developing/metering station 100*a* are controlled with power source control 39*a*.

The development takes place for the second color for example magenta, as follows: the developed latent image on image belt 20 is recharged with charging unit 44*a*. The developed image is re-exposed by ROS 24*b,* ROS 24*b* superimposing a second color image bitmap information over the previously developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other, as described in U.S. Pat. No. 5,477317 the relevant portions of which are hereby incorporated by reference herein. At ink application station 30*b,* ink applicator 32*b,* rotating in the direction of the arrow shown, advances a liquid developer material 34*b* from the chamber of housing 35*b* to ink application nip 36*b*. The toner particles, disseminated through the liquid carrier, pass by electrophoresis to the second electrostatic image. Multiple zone conditioning assembly 100*b* receives the developed image on image belt 20 and conditions the image by reducing fluid content while inhibiting the departure of toner particles from the image. The image on image belt 20 advances to lamps 40*b* where any residual charge left on the photoconductive surface is extinguished by flooding the photoconductive surface with light from lamp 40*b*. Sensor 42*b* senses the developability of a development patch which has been developed and metered by development/metering station 100*b*. Based on the developed image information from sensor 42*b,* the temperature of the heating elements of developing/metering station 100*b* are controlled with power source control 39*b*.

The development takes place for the third color for example cyan as follows: the developed latent image on image belt 20 is recharged with charging unit 44*b*. The developed latent image is re-exposed by ROS 24*c,* ROS 24*c* superimposing a third color image bitmap information over the previously developed images. At development and conditioning station 30*c,* image coating assembly 32*c,* rotating in the direction of the arrows shown, advances a liquid developer material 34*c* from the chamber of housing 35*c* to image coating zone 36*c*. The toner particles, disseminated through the liquid carrier, pass by electrophoresis to the third electrostatic image. Multiple zone conditioning assembly 100*c* receives the developed image on image belt 20 and conditions the image by reducing fluid content. The image on image belt 20 advances to lamps 40*c* where any residual charge left on the photoconductive surface is extinguished by flooding the photoconductive surface with light from lamp 40*c*. Sensor 42*c* senses the developability of a development patch which has been developed and metered by development/metering station 100*c*. Based on the developed image information from sensor 42*c,* the temperature of the heating elements of developing/metering station 100*c* are controlled with power source control 39*c.*

The development takes place for the fourth color, for example black, as follows: the developed latent image on image belt 20 is recharged with charging unit 44*c.* The developed image is re-exposed by ROS 24*d,* ROS 24*d* superimposing a fourth color image bitmap information over the previously developed latent image. At development and conditioning station 30*d,* image coating assembly 32*d,* rotating in the direction of the arrow as shown, advances liquid developer material 34*d* from the chamber of housing 35*d* to image coating zone 36*d.* The toner particles, disseminated through the liquid carrier, pass by electrophoresis to the fourth electrostatic image. Multiple zone conditioning assembly 100*d* receives the developed image on image belt 20 and conditions the image by reducing fluid content to a desired amount. The image on image belt 20 advances to lamps 40*d* where any residual charge left on the photoconductive surface is extinguished by flooding the photoconductive surface with light from lamp 40*d.* Sensor 42*d* senses the developability of a development patch which has been developed and metered by development/metering station 100*d.* Based on the developed image information from sensor 42*d,* the temperature of the heating elements of developing/metering station 100*d* are controlled with power source controller 39*a.*

The resultant image, a multi-layer image by virtue of the developing station 30*a,* 30*b,* 30*c* and 30*d* having yellow, magenta, cyan and black toner disposed therein advances to an intermediate transfer station. It should be evident to one skilled in the art that the color of toner at each development and conditioning station could be in a different arrangement. At the intermediate transfer station, the resultant image is electrostatically transferred to intermediate member 50 by belt transfer rollers 44.

Intermediate belt 50 provides the opportunity for further image conditioning, which can be done by blotting roller 52 or heat assisted evaporation. The further conditioned image is therefore more suitable for transfuse 55. Subsequently, multi-layer image, present on the surface of the intermediate member passes heating element 54, which not only heats the external wall of the intermediate member in the region of transfix nip 55, but because of the mass and thermal conductivity of the intermediate member, generally maintains the outer wall of member 50 at a temperature sufficient to cause the toner particles present on the surface to melt and stay tacky until the image passes through the transfix nip. At transfix nip 55, backup pressure roller 56 contacts the surface of recording sheet 58. After the developed image is transferred to recording sheet 58, intermediate member 50 is cleaned and cooled at intermediate member cleaning station 60.

After image belt 20 passes the transfer station, residual liquid developer material remaining on the belt is removed at belt cleaning station 70. Any number of photoconductor cleaning means exist in the art, any of which would be suitable for use. Any residual charge left on the photoconductive surface is extinguished by flooding the photoconductive surface with light from lamp 72.

An electronic control subsystem controls various components and operating subsystems of the reproduction machine. The control subsystem handles control data including control signals from control sensors for the various controllable aspects of the machine.

It is highly desirable to have an enhanced image conditioning process, especially for cases where highly viscous carrier fluids are used or process speeds are very high. Studies show that the metered film thickness is greatly determined by the viscosity of the carrier fluids, other conditions remaining constant, and that thinner films can be obtained with less viscous liquids. That is, the solids contents of the developed images after metering can be controlled by manipulating the viscosity of the carrier fluids when electrostatics, geometrical dimensions and component velocities are constant.

Figure 2:
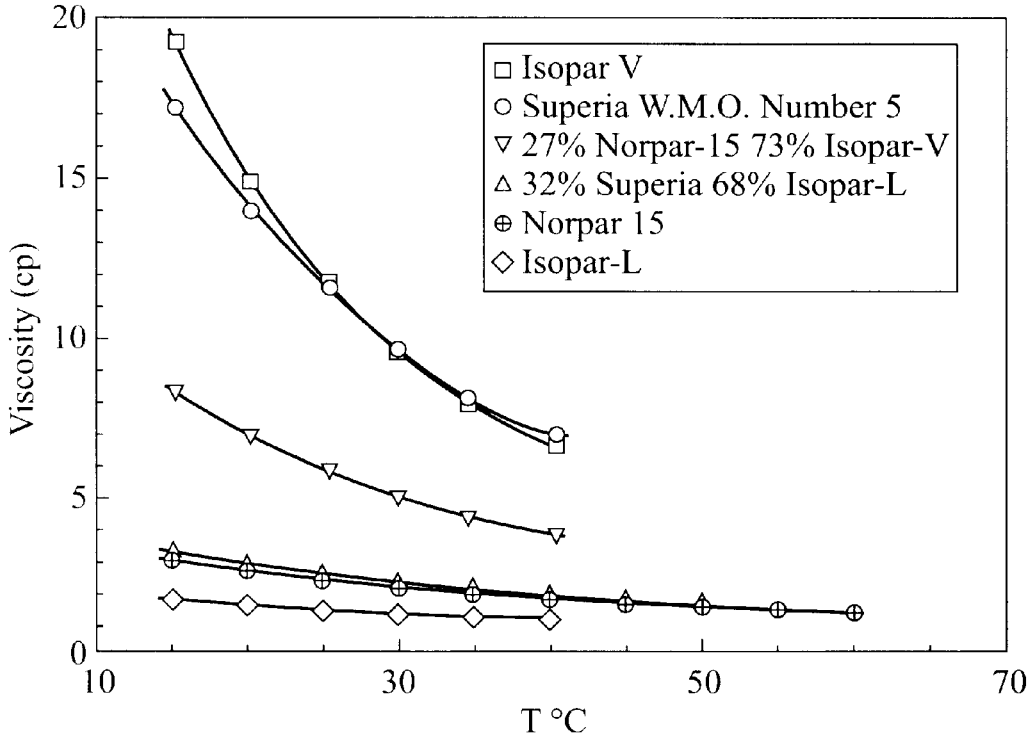
FIG. 2 plots viscosity of carrier fluids versus temperature.

One way to change the viscosity of the developer fluid is to change the temperature of the carrier fluid. FIG. 2 plots viscosity of carrier fluids versus temperature. As can be seen, the viscosity of the tested carrier fluids are temperature sensitive, i.e., their viscosities can be reduced by increasing the temperature. For example, the viscosity of Superla varies from 12 cp to 7 cp when temperature changes from 25 to 40 degrees Celsius. Using the fact that heating carrier fluids lowers their viscosities, the present invention enhances the metering process by heating the ink in the vicinity of a multiple zone image conditioning apparatus, which results in lower metered film thickness and better developability.

Figure 3:
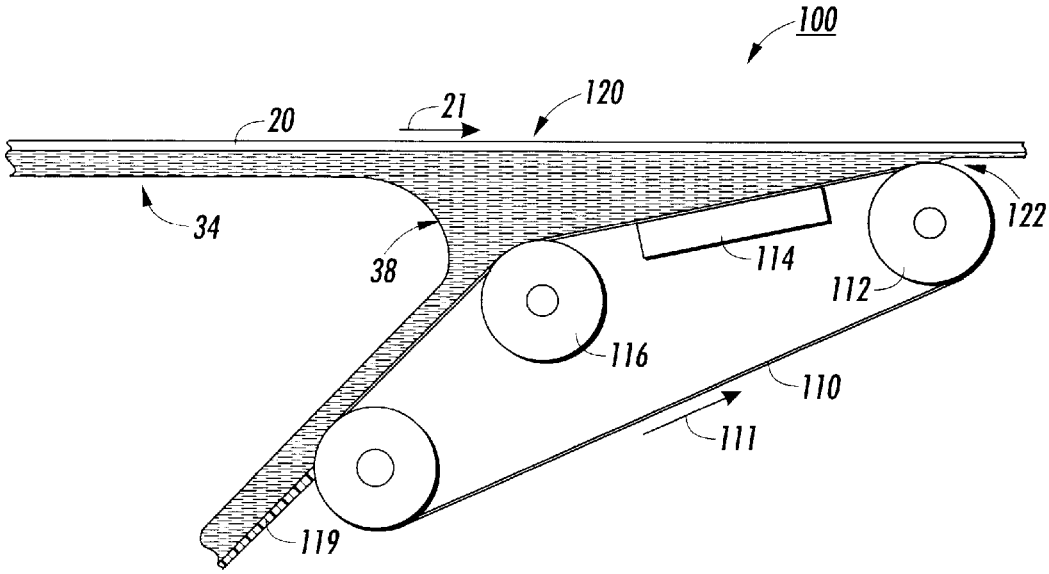
FIG. 3 illustrates a first embodiment of the present invention with the image enhancement mechanism in the form of a developing/metering belt.

FIG. 3 shows a first embodiment of the invention which uses a combined developing/metering belt 110 for the multiple zone image conditioning apparatus 100, the first zone being development zone 120 and the second zone being metering zone 122. Developing/metering belt 110, for example, made of electroformed nickel or stainless steel, travels through metering zone 122 and development zone 120 and is supported by heating roller 112, heating pad 114, heating roller 116 and drive roller 118 with skiver 119.

Preferably heating member 112 which supports developing/metering belt 110 is an air bearing which urges developing/metering belt against developer fluid 34 and image belt 20 to perform the metering function. The air bearing can be also used to prevent accumulation of developer fluid on the inside of the developing/metering belt and can be in the form of an air knife as well as other well known fluid bearing devices.

Heating pad 114 can also serve as a shaped stationary backing for developing/metering belt 110. There are many ways to increase the temperature of the heating elements, for example, having heating pad 114 externally heated by the application of a voltage difference from inboard to outboard, or the belt itself can be heated by the application of a voltage difference between heating member 112 and heating pad 114.

Developer fluid 34, which has been applied by ink application nip 36*a–d,* travels to development zone 120 on image belt 20, image belt 20 moving in the direction as shown by arrow 21. Developer fluid meniscus 38 is formed at the front end of development zone 120, between image belt 20 and developing/metering belt 110. Developing/metering belt 110 is driven by drive roller 118 and travels in the direction indicated by arrow 111, this movement carrying away excess developer fluid from the developed image. As developing/metering belt 110 travels over drive roller 118, skiver 119 presses against it in order to clean developing/metering belt 110 of excess developer fluid 34 prior to its re-entering metering zone 122. The excess developer 34 fluid returns to housing 35 or a sump (not shown).

Heating rollers 112, 116, 118 and heating pad 114 heat the developer fluid 34 as it travels past the multiple zone image conditioning apparatus 100. Heating the developer fluid in this manner causes the viscosity of the developer fluid in development/metering zone 122 to decrease and after the developed image is properly conditioned by developing/ metering belt 110, results in thinner developed films with higher solids contents than without heating.

Figure 4:
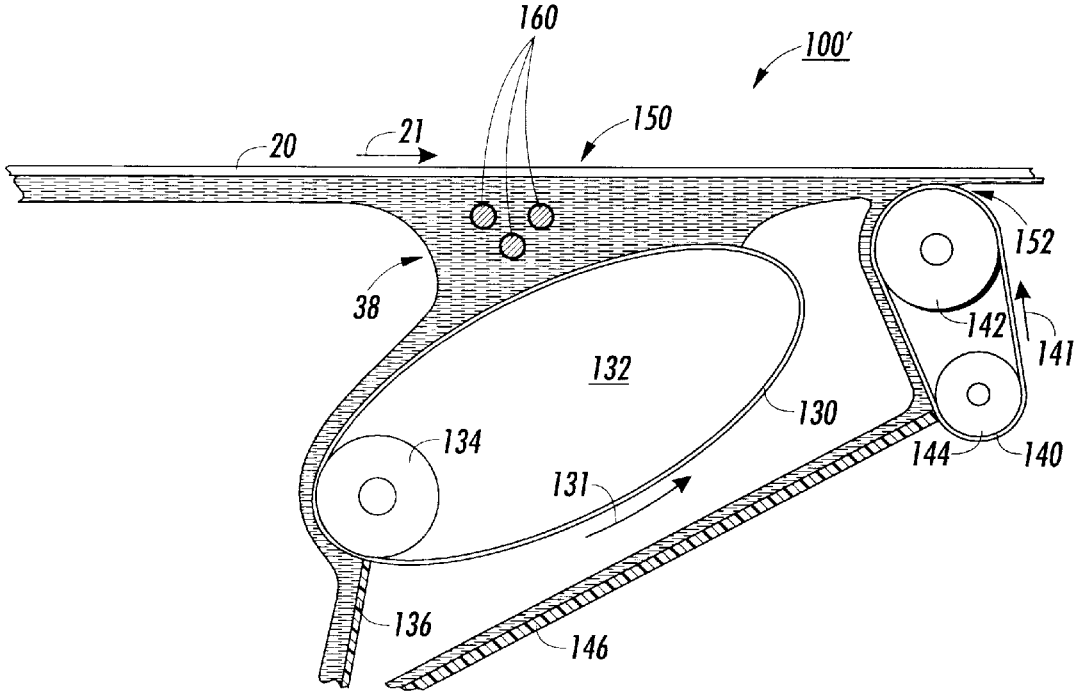
FIG. 4 illustrates a second embodiment of the present invention with the image enhancement mechanism in the form of a development member and a metering member.

FIG. 4 shows an embodiment of the present invention in which the development zone 150 and metering zone 152 are separated for the multiple zone image conditioning apparatus 100. Developing belt 130 is supported by shaped shoe 132 which positions developing belt 130 at the desired position in development zone 150 with respect to image belt 20. Drive roller 134 is located at one end of shaped shoe 132 and causes developing belt 130 to travel in the direction of arrow 131. Skiver 136 presses against drive roller 134 to clean developing belt 130. Developing belt 130 is made of heat conductive material, for example, electroformed nickel or stainless steel.

A separate heat conductive metering belt 140 is positioned at metering zone 152, metering belt being supported by rollers 142 and 144 and travels in the direction as indicated by arrow 141. Roller 142 supports, preferably with an air bearing, and urges metering belt 140 into contact with developer fluid 34 to perform the metering function. Skiver 146 presses against metering belt 140 to clean the metering belt as it travels over rollers 142 and 144. Rollers 142 and 144 may be heated to heat metering belt or metering belt 140 may be heated by some other means. In this configuration, the efficiency of heating at metering zone 152 is considered better since the liquid film is already much thinner after it exits development zone 150 and enters metering zone 152.

A novel way to heat the fluid without much heating of image belt 20 is to use heating wires 160. The number of wires can vary from one to a few as long as they do not obstruct fluid flow into the development zone. Thus, the wire diameter must be as small as possible, for example, a wire with a diameter ranging from about 0.001–0.005 inches. The wire material can be any material which generates the desired amount of heat and can range from stainless steel to tungsten or alloys of gold or platinum.

Heating wires 160 can be embedded in the liquid reservoir which is formed in the upstream region near the front end of developer fluid meniscus 38. Taking advantage of the knowledge of the flow field of developer fluid 34, the locations of the heating wires are chosen so that the wires heat up most of the fluid as the fluid goes downstream into metering zone 152. In other words, the metered film is basically heated by convection. By doing so, the image belt 20 is not overheated while the temperature rise in the liquid is enough to significantly reduce its viscosity.

Preferred materials for metering belt 140 and heating wires 160 are highly heat conductive materials, especially when they are heated by conventional external heaters. The materials may also be semi-conductive materials where the heat is internally generated by AC or DC currents.

Another property of forming a developed image to consider is developability and in liquid ink development, developability is a strong function of the viscosity of the developing fluid. Toner particles and charge director micelles respond to electric fields but their motions are retarded by the viscous drag of the surrounding fluid. As discussed above, controlling the viscosity of the fluid by temperature in the metering gap for the purpose of reducing the minimum exiting toner layer thickness while maintaining desired maximum developed mass per unit area (DMA) is desirable. Further developing this concept, the viscosity of carrier fluid in the development zone can be manipulated to enable stable density output by a feedback control of the fluid temperature. The advantage of feedback control to power supplies maintaining fluid temperature is a quick response time. Feedback control is accomplished with sensors 42*a–d* which measure the developability of each of the applied colors. Based on the developed image information for the particular developing station, the temperature of the heating elements of developing/metering stations 100*a–d* are controlled with power source controllers 39*a–d*.

Figure 5:
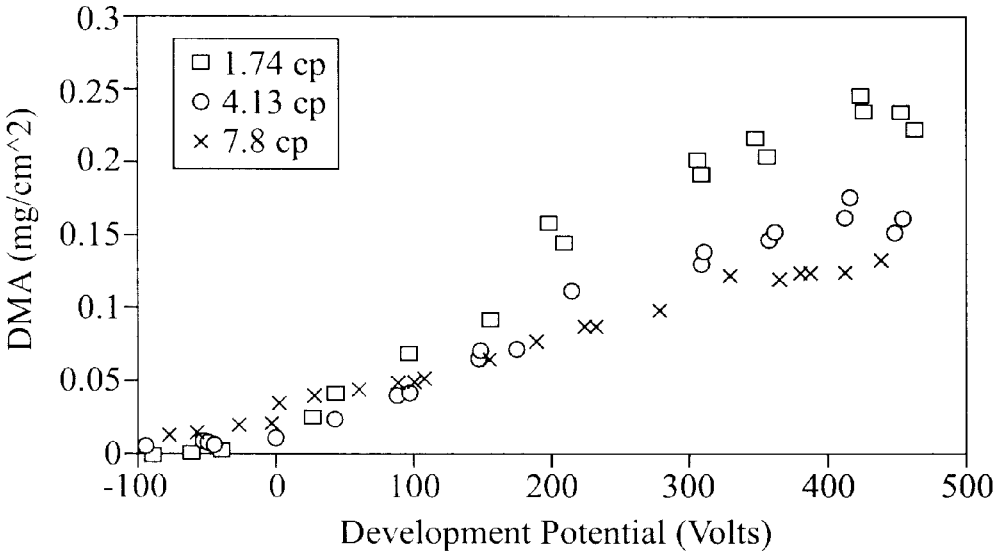
FIG. 5 shows developed mass per unit area versus development potential for liquid inks.

As discussed above, with respect to FIG. 2, increasing the temperature of the carrier fluid decreases its viscosity. Developability is also shown to depend on viscosity in FIG. 5 which shows developed mass per unit area versus development potential for an imaging member with a thickness of 15 microns, process speed of 20 ips (16 ips for 7.8 cp carrier fluid), metering speed of 20 inches per second, metering roll diameter of 6 inches, metering gap of 0.002 inches for varying viscosity carrier fluids.

While image developability increases with reduction in viscosity, background development decreases with the same reduction in viscosity. The reason for this is that particle mobility is increased for both image development and background control simultaneously. This is an advantage over conventional methods in xerography for increasing developability by increasing toner concentration or Vddp because conventionally background development would also increase with image development. Therefore, conventionally either Vbias or exposure, or both, are adjusted to compensate, thereby altering the electrostatic conditions in the development zone. Thus an additional advantage of decreasing the viscosity of carrier fluids by increasing their temperature to control developability can be accomplished while the electrostatic image and electrostatics of the development process are kept constant.

This aspect of the invention may be implemented as shown in FIG. 3 and 4 discussed above, however, when solely addressing developability, only development zones 120 and 150 are heated to lower developer fluid 34 viscosity. With the aid of convective heat transfer, only a thin layer of fluid (a few thousandths of an inch), which eventually enters the effective development zone, needs to be heated. By such heating process, the viscosity of the fluid can be significantly reduced when it enters the effective development zone. Hence, the development of the unaltered electrostatic image can proceed further to completion. This is of significant advantage when developing at high process speed with high viscosity inks.

Since the flow rate of the fluid layer required to be heated is relatively low, response time is therefore short in this application. The following advantages of including developability control by temperature as an additional or alternative to conventional systems include: machine start up from cold is quick and stable operation is achieved reliably, environmentally caused development variabilities are eliminated, and a wider range of ink properties and process speeds can be accommodated with a given setup thereby increasing process latitudes. The electrostatic image is unaltered by this control scheme thereby allowing stable photoreceptor operation and background cleaning is simultaneously enhanced as image development increases. A simpler control strategy can be devised for the development of lines and halftone dots than the conventional control schemes where exposure variations are necessary to compensate for the undesirable increase in background development which can result from increasing image developability.

It is, therefore apparent that there has been provided in accordance with the present invention a liquid ink development apparatus and method which fully satisfies the aims and advantages set for herein. While the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for liquid ink development, comprising:

an image formation member with a latent image formed thereon which travels in a process direction;

an ink application member which applies liquid ink to the image formation member to form a developed image area which includes a developed image, the liquid ink including toner;

a biased image enhancement member which develops the latent image with the toner; and at least one heating member which heats the liquid ink, thereby controlling the temperature of the liquid ink while the toner is being developed on the developed image area.

2. The apparatus of claim 1, wherein the biased image enhancement member comprises:

a metering member which removes excess liquid from the biased image formation member and compacts the developed image in a metering zone, the at least one heating member controlling the temperature of the metering member.

3. The apparatus of claim 2, wherein the biased image enhancement member further comprises:

a development member which develops toner and removes excess liquid ink from the developed image area in a development zone located prior to the metering member in the process direction.

4. The apparatus of claim 3, wherein the at least one heating member further comprises:

a second heating member located in the development zone which controls the temperature of the development member.

5. The apparatus of claim 1, wherein the biased image enhancement member comprises:

a development member which removes excess liquid ink from the developed image area in a development zone, the at least one heating member controlling the temperature of the development member.

6. The apparatus of claim 5, wherein the at least one heating member is at least one heated wire located in the development zone.

7. The apparatus of claim 1, wherein the biased image enhancement member comprises:

a developing/metering belt which removes excess liquid ink from the developed image area in a development zone and removes excess liquid ink from the developed image area and compacts the developed image area in a metering zone, the at least one heating member controlling the temperature of the developing/metering belt.

8. The apparatus of claim 7, wherein the at least one heating member is located in the development zone.

9. The apparatus of claim 8, wherein the at least one heating member further comprises:

a second heating member located in the metering zone.

10. The apparatus of claim 7, wherein the at least one heating member is located in the metering zone.

11. An apparatus for liquid ink development, comprising:

an image formation member with a latent image formed thereon which travels in a process direction:

an ink application member which applies liquid ink to the image formation member to form a developed image area which includes a developed image;

an image enhancement member which removes excess liquid ink from the developed image area; and at least one heating member which controls the temperature of the developed image area, the at least one heating member heating the liquid ink after the liquid ink has been applied to the image formation member; further comprising:

a sensor which senses the developability of the developed image; and a controller connected to the sensor, the controller controls the temperature of the at least one heat member based on the developability sensed by the sensor.

12. A method for enhancing liquid ink development, comprising the steps of:

applying liquid ink to an image formation member having a latent image formed thereon at an ink application station thereby forming a developed image area on the image formation member, the developed image area including a developed image, the liquid ink including toner;

removing excess liquid ink from the developed image area with an image enhancement member; and controlling the temperature of the liquid ink while the toner is being developed on the developed image area.

13. The method of claim 12, wherein removing the excess liquid ink comprises a step of:

metering the liquid ink on the developed image area with the image enhancement member including a metering member which removes excess liquid ink from the developed image area and compacts the developed image.

14. The method of claim 13, wherein controlling the temperature of the liquid ink on the developed image area includes a step of:

controlling the temperature of the metering member.

15. The method of claim 13, wherein removing the excess liquid ink further comprises a step of:

developing the toner by means of the image enhancement member including a development member which removes excess ink from the developed image area prior to metering the liquid ink on the developed image area.

16. The method of claim 15, wherein controlling the temperature of the liquid ink on the developed image area includes a step of:

controlling the temperature of the development member.

17. The method of claim 12, wherein removing the excess liquid ink comprises a step of:

developing the toner by means of the image enhancement member in the form of a development member which removes excess ink from the developed image area.

18. The method of claim 17, wherein controlling the temperature of the liquid ink on the developed image area includes a step of:

controlled heating of the liquid ink.

19. A method for enhancing liquid ink development, comprising:

applying liquid ink to an image formation member having a latent image formed thereon at an ink application station thereby forming a developed image area on the image formation member, the developed image area including a developed image;

removing excess liquid ink from the developed image area with an image enhancement member; and controlling the temperature of the liquid ink on the developed image area with at least one heating member after the liquid ink has been applied to the image formation member while removing the excess liquid ink with the image enhancement member; wherein removing the excess liquid ink comprises:

metering the liquid ink on the developed image area with the image enhancement member including a metering member which removes excess liquid ink from the developed image area and compacts the developed image; further comprising:

sensing the developability of the metered image with a sensor;

controlling the temperature of the at least one heating member based on the sensed developability of the metered image.

20. A method for liquid ink development, comprising the steps of:

moving an image formation member in a process direction;

applying liquid ink to an image formation member having a latent image formed thereon at an ink application station thereby forming a developed image area on the image formation member the liquid ink including toner;

removing excess liquid ink from the developed image area with a development member;

removing excess liquid ink from the developed image area with a metering member after the development member as the image formation member moves in the process direction; and controlling the temperature of the liquid ink while the toner is being developed on the developed image area by means of at least one heating member.

* * * * *